US010934903B2

(12) United States Patent
Sato et al.

(10) Patent No.: US 10,934,903 B2
(45) Date of Patent: Mar. 2, 2021

(54) OIL PAN AND METHOD FOR MANUFACTURING OIL PAN

(71) Applicant: PACIFIC INDUSTRIAL CO., LTD., Ogaki (JP)

(72) Inventors: Hiroyuki Sato, Motosu-gun (JP); Tomonari Inoue, Ogaki (JP); Takahiro Shimizu, Ogaki (JP)

(73) Assignee: PACIFIC INDUSTRIAL CO., LTD., Ogaki (JP)

( * ) Notice: Subject to any disclaimer, the term of this patent is extended or adjusted under 35 U.S.C. 154(b) by 459 days.

(21) Appl. No.: 15/770,582

(22) PCT Filed: Nov. 6, 2015

(86) PCT No.: PCT/JP2015/081258
§ 371 (c)(1),
(2) Date: Apr. 24, 2018

(87) PCT Pub. No.: WO2017/077631
PCT Pub. Date: May 11, 2017

(65) Prior Publication Data

US 2018/0313240 A1 Nov. 1, 2018

(51) Int. Cl.
*F01M 11/00* (2006.01)
*F02F 7/00* (2006.01)
*F02B 77/13* (2006.01)

(52) U.S. Cl.
CPC ..... *F01M 11/0004* (2013.01); *F02B 77/13* (2013.01); *F02F 7/008* (2013.01); *F02F 7/0021* (2013.01); *F01M 2011/0012* (2013.01)

(58) Field of Classification Search
CPC ..... F01M 11/0004; F01M 2011/0012; F02B 77/13; F02F 7/0021; F02F 7/008
See application file for complete search history.

(56) References Cited

U.S. PATENT DOCUMENTS 4,793,299 A * 12/1988 Ishimura ..... F02F 7/008 123/195 A
4,851,271 A * 7/1989 Moore, III ..... F02F 7/006 428/34.5
5,143,755 A * 9/1992 Moore, III ..... F02F 7/006 427/373

(Continued)

FOREIGN PATENT DOCUMENTS

CN 202417639 U 9/2012
EP 2 093 395 A1 8/2009

(Continued)

OTHER PUBLICATIONS

Amazon listing for Spectre Performance 5482 Oil Pan (Year: 2020).*

(Continued)

*Primary Examiner* — Michael R Mansen
*Assistant Examiner* — Robert T Reese
(74) *Attorney, Agent, or Firm* — Oliff PLC

(57) ABSTRACT

In an oil pan, an outer surface of an oil pan body is covered with urethane foam material. The outer surface of the oil pan body is cation treated to be a surface-treated layer, and the urethane foam material is adhered to the outer surface of the oil pan body by the surface-treated layer without any gaps therebetween. The oil pan further includes an undulating portion formed on the outer surface of the oil pan body and undulating in an inward and outward direction. The surface-treated layer is formed on the undulating portion and the urethane foam material is adhered to the undulating portion without any gaps therebetween. The undulating portion includes a bowl-shaped recess recessed into a bowl shape toward an inner side of the oil pan body and the urethane foam material is adhered to an entire inner surface of the bowl-shaped recess without any gaps therebetween.

8 Claims, 10 Drawing Sheets

(56) References Cited

U.S. PATENT DOCUMENTS

| | | | | |
|---|---|---|---|---|
| 5,218,938 | A * | 6/1993 | Miller | F01M 11/0004 123/195 C |
| 5,271,142 | A * | 12/1993 | Moore, III | B21D 22/205 29/469.5 |
| 2003/0024768 | A1* | 2/2003 | Jones | F01M 11/0004 184/1.5 |
| 2006/0169240 | A1* | 8/2006 | Hanner | F01M 11/0004 123/195 C |
| 2016/0109062 | A1* | 4/2016 | Antonakakis | F01M 11/0004 701/36 |
| 2017/0129204 | A1* | 5/2017 | Mori | B32B 27/12 |

FOREIGN PATENT DOCUMENTS

| | | | |
|---|---|---|---|
| JP | S61-162557 | U | 10/1986 |
| JP | H02-37250 | U | 3/1990 |
| JP | H09-290940 | A | 11/1997 |
| JP | 2000-157921 | A | 6/2000 |
| JP | 2004-251109 | A | 9/2004 |
| JP | 2006-161680 | A | 6/2006 |
| JP | 2008-150974 | A | 7/2008 |
| JP | 2 093 395 | A1 | 8/2009 |
| KR | 10-0780990 | B1 | 11/2007 |

OTHER PUBLICATIONS

Oct. 2, 2018 Supplementary European Search Report issued in European Patent Application No. 15907817.9.

May 8, 2018 International Preliminary Report on Patentability issued in International Patent Application No. PCT/JP2015/081258.

Feb. 2, 2016 International Search Report issued in International Patent Application No. PCT/JP2015/081258.

* cited by examiner

OIL PAN AND METHOD FOR MANUFACTURING OIL PAN

TECHNICAL FIELD

The present invention relates to an oil pan having an oil pan body with an outer surface being covered with a urethane foam material and to a method for manufacturing the same.

BACKGROUND ART

An oil pan in which a sound absorbing sheet is attached to an outer surface of the oil pan body for the purpose of reducing vibration and noise caused by the oil pan is conventionally known (see e.g., Patent Literature 1).

CITATIONS LIST

Patent Literature

Patent Literature 1: Japanese Unexamined Utility Model Application Publication No. 2-37250 (P. 5, lines 7 to 11, FIG. 1).

SUMMARY OF INVENTION

Technical Problems

However, in the conventional oil pan described above, a gap is likely to be produced between the sound absorbing sheet and the oil pan, and there is a problem that it is difficult to improve the effect of reducing the vibration and the noise caused by the oil pan.

The present invention was made in view of the above circumstances, and it is an object thereof to provide an oil pan and a method for manufacturing the same such that the vibration and noise reduction effect can be improved.

Solutions to Problems

In an oil pan according to an aspect of the present invention having an oil pan body with an outer surface being covered with a urethane foam material. The outer surface of the oil pan body is cation treated to be a surface-treated layer, and the urethane foam material is adhered to the outer surface of the oil pan body by the surface-treated layer without any gaps therebetween. The oil pan further includes an undulating portion formed on the outer surface of the oil pan body and undulating in an inward and outward direction, where the surface-treated layer is formed on the undulating portion, and the urethane foam material is adhered to the undulating portion without any gaps therebetween. The undulating portion includes a bowl-shaped recess recessed into a bowl shape toward an inner side of the oil pan body and the urethane foam material is adhered to an entire inner surface of the bowl-shaped recess without any gaps therebetween.

A method for manufacturing oil pan according to an aspect of the present invention having an outer surface of an oil pan body covered with a urethane foam material comprises press molding a sheet metal to form the oil pan body, performing a cation treatment to the outer surface of the oil pan body, inserting the oil pan body after the cation treatment into a foaming mold, and foaming a urethane resin in the foaming mold to adhere the urethane foam material to the outer surface of the oil pan body. When forming the oil pan body, an undulating portion undulating in an inward and outward direction is formed in the outer surface of the oil pan body, and the urethane foam material is adhered to the outer surface of the undulating portion. When forming the undulating portion, a bowl-shaped recess recessed into a bowl shape toward the inner side of the oil pan body is formed.

DESCRIPTION OF EMBODIMENTS

Figure 1:
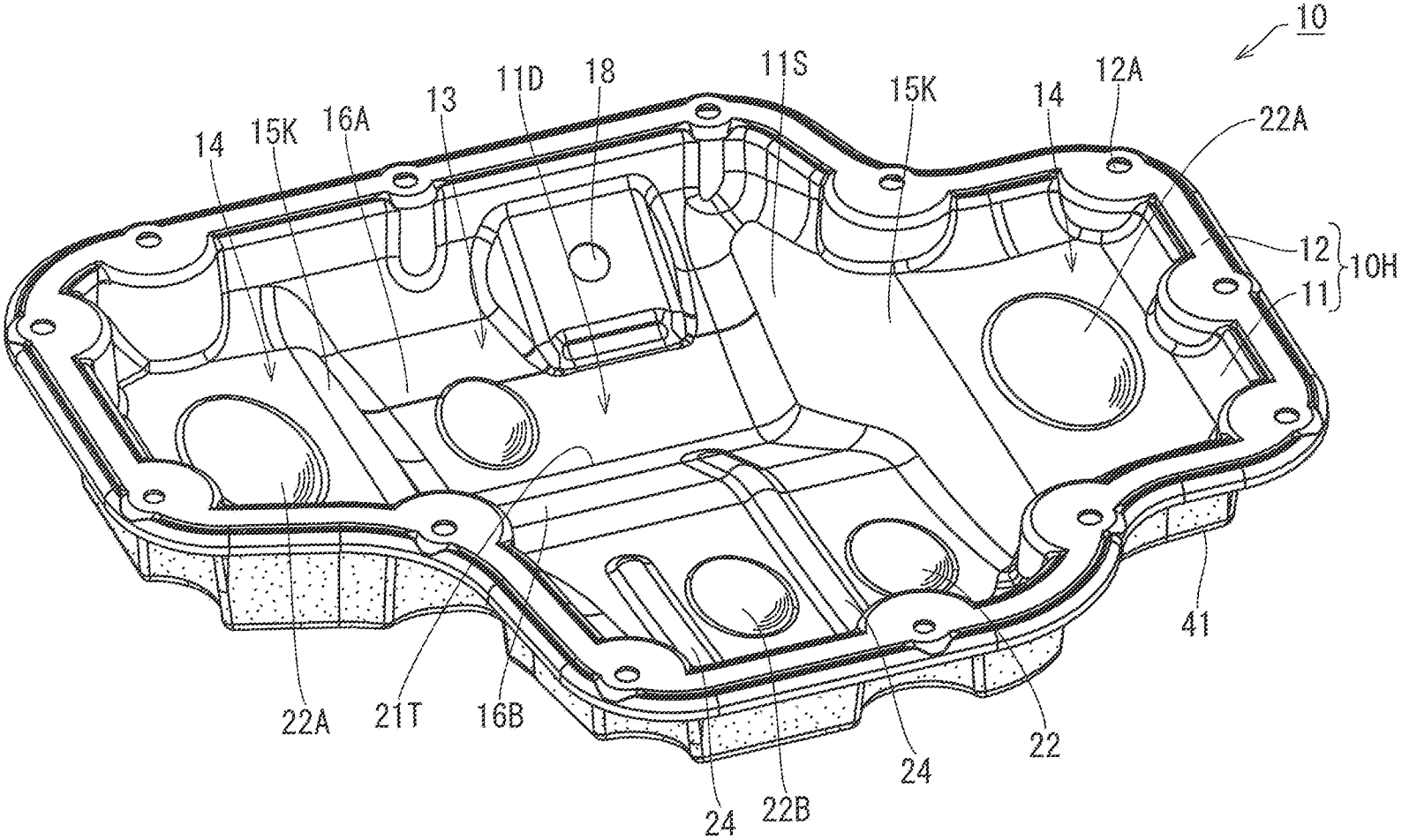
FIG. 1 is a perspective view of an oil pan according to one embodiment seen from an upper side.

One embodiment will be hereinafter described below based on FIGS. 1 to 10. As shown in FIG. 1, an oil pan 10 according to the present embodiment includes an oil pan body 10H. The oil pan body 10H is a press molded article of a sheet metal, and has a structure in which a flange section 12 is bulged out from an open edge of a container section 11, which is flat in an up and down direction. The flange section 12 is provided with a plurality of bolt holes 12A for attaching the oil pan 10 to an engine (not shown).

Figure 2:
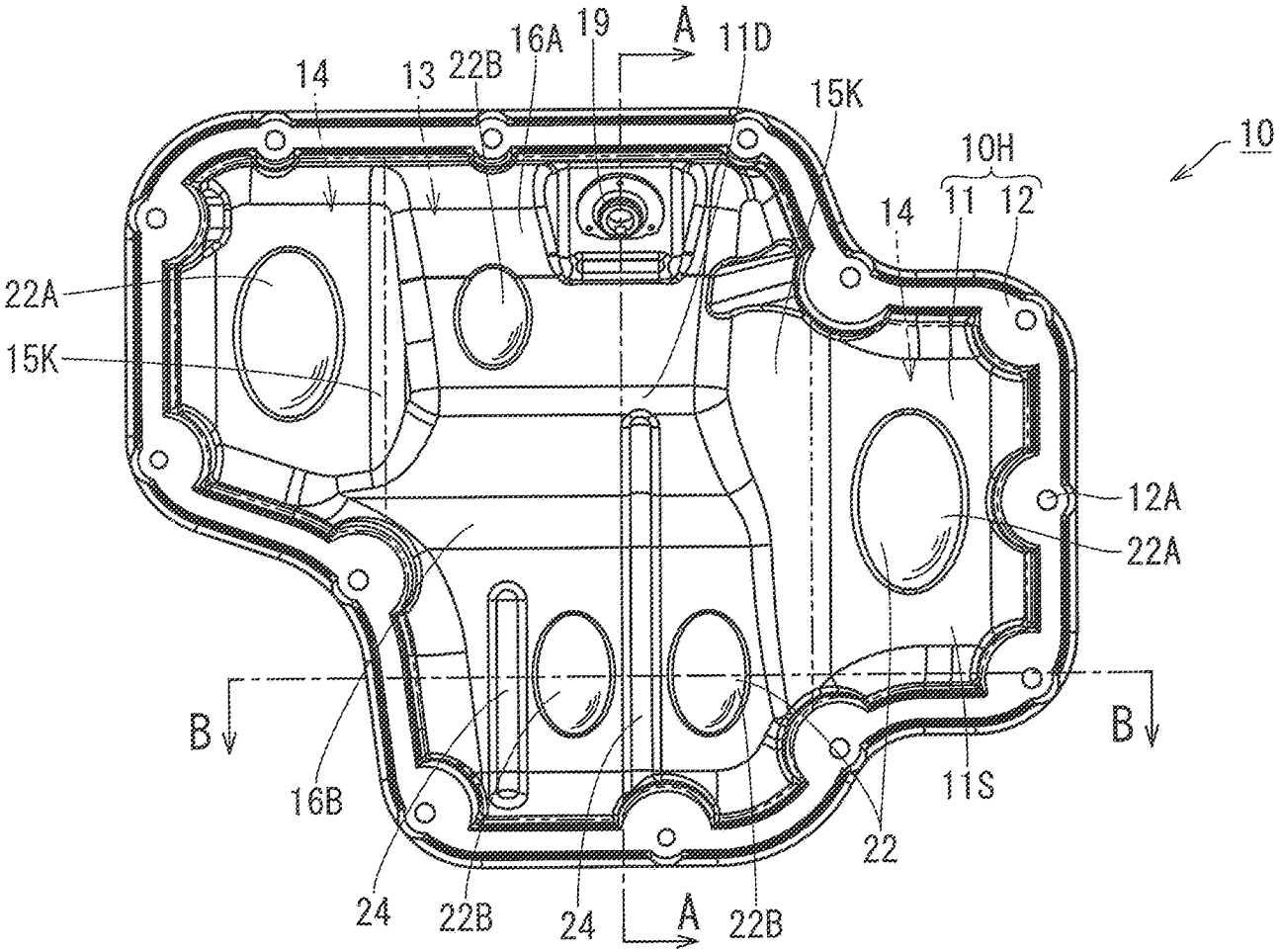
FIG. 2 is a plan view of the oil pan.

As shown in FIGS. 1 and 2, the container section 11 of the oil pan body 10H is configured with a band-shaped intermediate portion 13 having a substantially square shape in plan view, and a pair of side bulge-out portions 14, 14 bulging out toward the outer side from a long side portion of the band-shaped intermediate portion 13. The depth of the band-shaped intermediate portion 13 is deeper than the depth of the side bulge-out portion 14. A side guiding inclined, portion 15K that guides the oil accumulated at the side bulge-out portion 14 toward the band-shaped intermediate portion 13 is formed at a boundary portion of the band-shaped intermediate portion 13 and the side bulge-out portion 14 in a bottom wall 11S of the container section 11.

Figure 5:
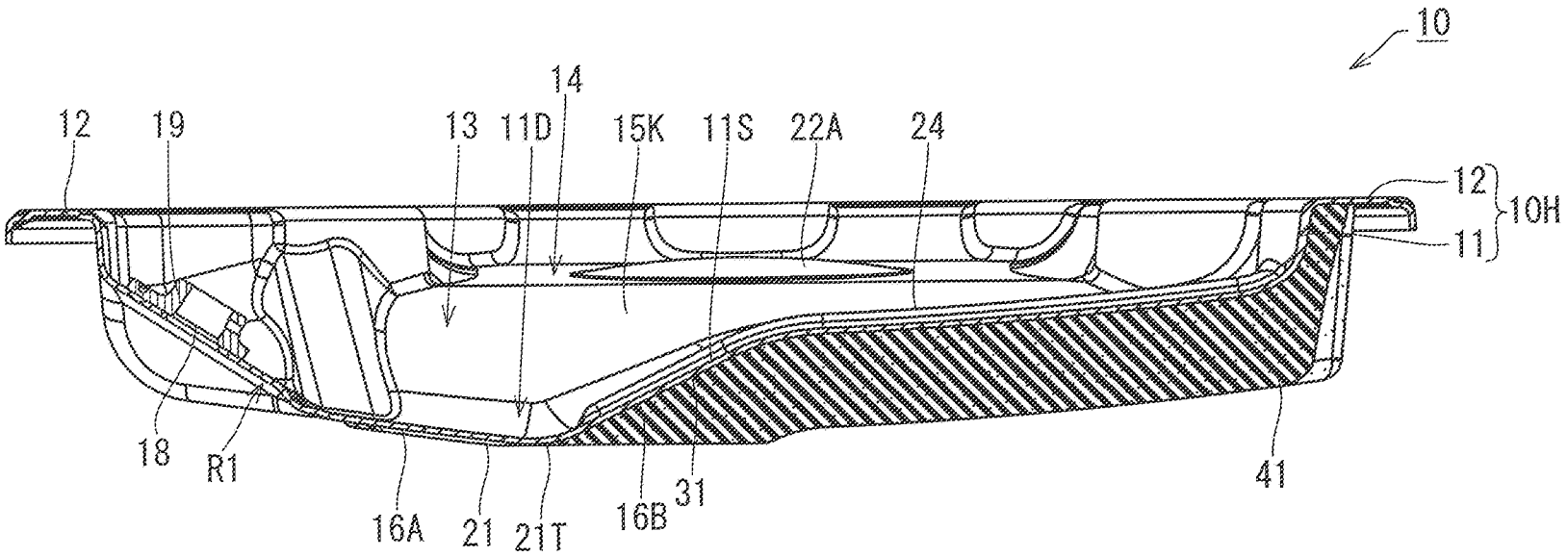
FIG. 5 is a cross-sectional view taken along line A-A of the oil pan in FIG. 2.

Furthermore, as shown in FIG. 5, a downward protrusion 21 projecting downward and constituting a deepest portion 11D of the container section 11 is formed at a portion constituting the band-shaped intermediate portion 13 in the bottom wall 11S of the container section 11. A first undulating portion 31 undulating in an inward and outward direction of the container section 11 is formed with the downward protrusion 21 on the outer surface of the container section 11. The downward protrusion 21 has a substantially V shape when seen from a short side direction of the band-shaped intermediate portion 13, and includes a linear top 21T extending in the short side direction of the band-shaped intermediate portion 13, a first intermediate inclined portion 16A arranged on one side in a longitudinal direction of the band-shaped intermediate portion 13 with respect to the linear top 21T, and a second intermediate inclined portion 16B arranged on the other side in the longitudinal direction of the band-shaped intermediate portion 13 with respect to the linear top 21T. The downward protrusion 21 is arranged closer to one side in the longitudinal direction of the band-shaped intermediate portion 13.

Furthermore, as shown in FIG. 1, the first intermediate inclined portion 16A of the downward protrusion 21 is provided with a discharging hole 18 for discharging the oil in the container section 11 to the outside. In FIG. 2, the oil pan body 10H in which a fixing ring 19, for fixing a cap (not shown) for closing the discharging hole 18, is attached to the discharging hole 18 is shown.

As shown FIGS. 1 and 2, the bottom wall 11S of the container section 11 is provided with a plurality of dome-shaped protrusions 22 that swell out in a dome shape. The dome-shaped protrusion 22 has an elliptical shape in plan view, where a long axis of the dome-shaped protrusion 22 is arranged along the longitudinal direction of the band-shaped intermediate portion 13 of the container section 11. Specifically, the dome-shaped protrusion 22 includes a large dome-shaped protrusion 22A and a small dome-shaped protrusion 22B which is smaller than the large dome-shaped protrusion 22A. The large dome-shaped protrusion 22A is arranged, one in each of the pair of side bulge-out portions 14, 14 of the container section 11, and the small dome-shaped protrusion 22B is arranged in plurals in the band-shaped intermediate portion 13 of the container section 11.

Figure 6:
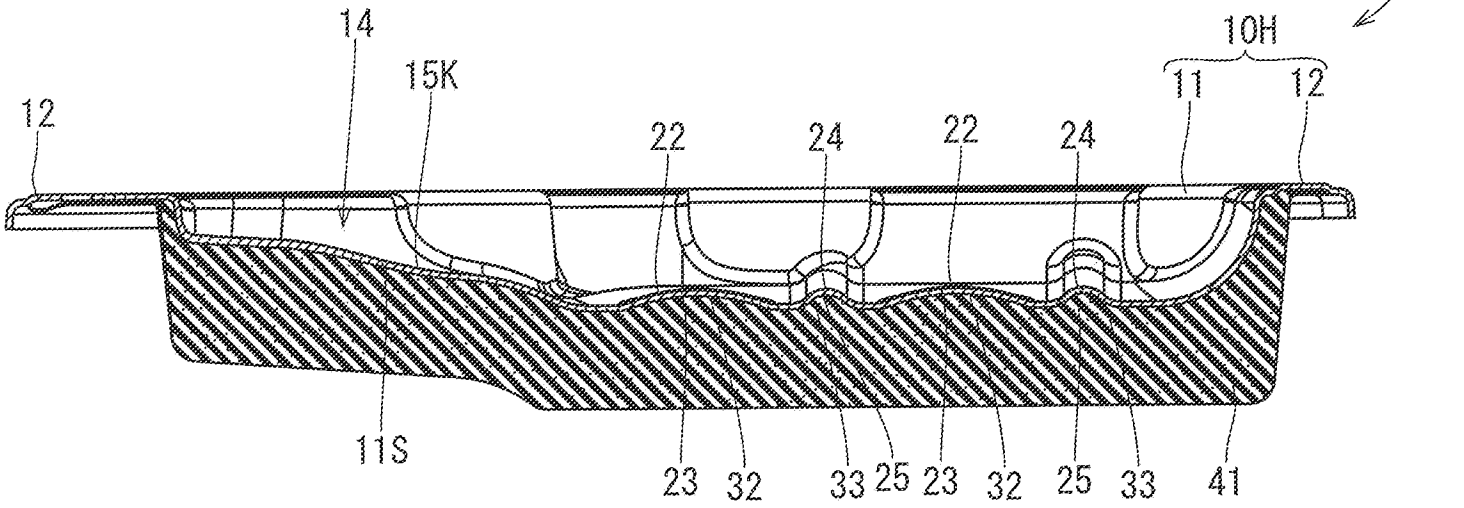
FIG. 6 is a cross-sectional view taken along line B-B of the oil pan in FIG. 2.

As shown in FIG. 6, the dome-shaped protrusion 22 is formed by depressing the bottom wall 11S of the container section 11 toward the inner side. Therefore, a bowl-shaped recess 23 recessed toward the inner side of the container section 11 is formed on the outer surface of the container section 11 in correspondence to the dome-shaped protrusion 22. A second undulating portion 32 undulating in the inward and outward direction of the container section 11 is formed with the bowl-shaped recess 23 on the outer surface of the container section 11.

As shown in FIGS. 1 and 2, a bank portion 24 extending along the longitudinal direction of the band-shaped intermediate portion 13 is arranged in plurals on the inner surface of the band-shaped intermediate portion 13 of the container section 11. Specifically, the plurality of bank portions 24 are arranged in line in the short side direction of the band-shaped intermediate portion, and are extended from an end on the other end side toward the one side, that is, from an end on a shallow side toward a deep side, in the longitudinal direction of the band-shaped intermediate portion 13. The oil accumulated in the band-shaped intermediate portion 13 is thereby easily guided toward the deepest portion 11D of the container section 11.

The bank portion 24 is formed by recessing the bottom wall 11S of the container section 11 toward the inner side, similarly to the dome-shaped protrusion 22 see FIG. 6). Therefore, a groove portion 25 recessed toward the inner side of the container section 11 is formed on the outer surface of the container section 11 in correspondence with the bank portion 24. A third undulating portion 33 undulating in the inward and outward direction of the container section 11 is formed with the groove portion 25 on the outer surface of the container section 11.

Figure 3:
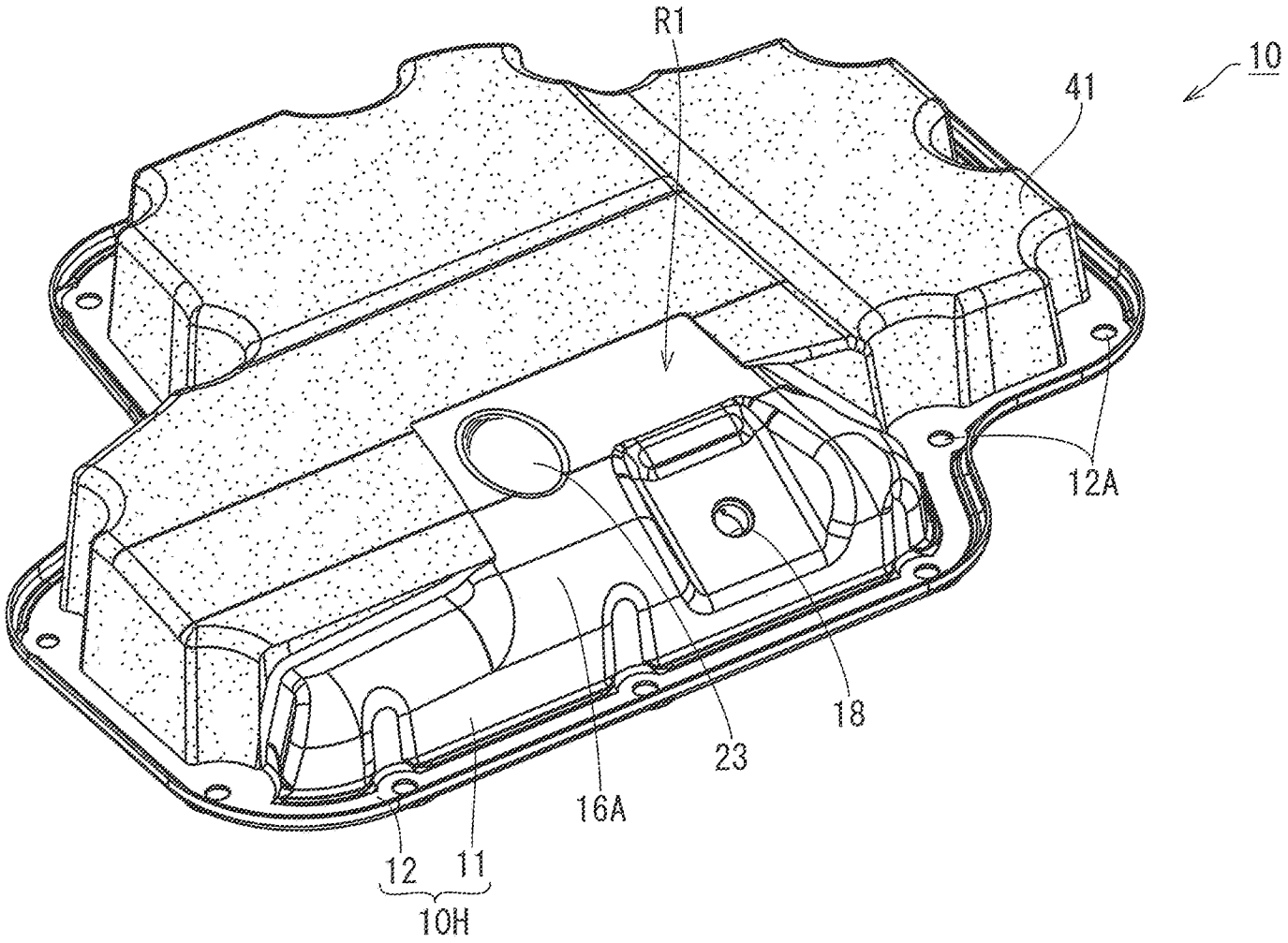
FIG. 3 is a perspective view of the oil pan seen from a lower side.
Figure 4:
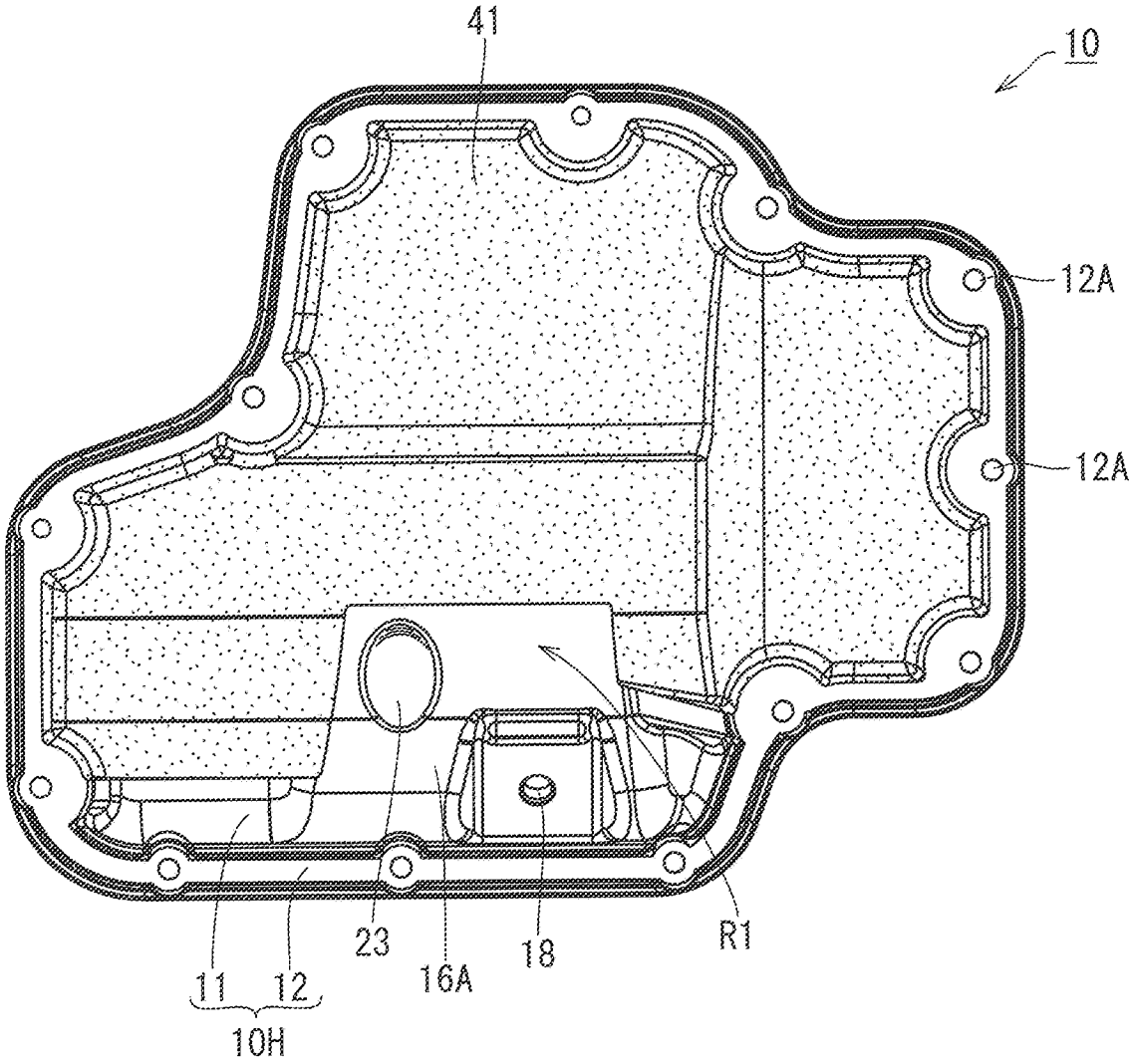
FIG. 4 is a bottom view of the oil pan.

As shown in, FIGS. 3 and 4, the outer surface of the oil pan body 10H is covered with a urethane foam material 41. The urethane foam material 41 is arranged avoiding an exposed region R1 including the discharging hole 18. The exposed region R1 is arranged on one side in the longitudinal direction of the band-shaped intermediate portion 13 with respect to the linear top 21T of the downward protrusion 21, and has a substantially square shape in plan view (see FIGS. 3 to 5).

Figure 7:
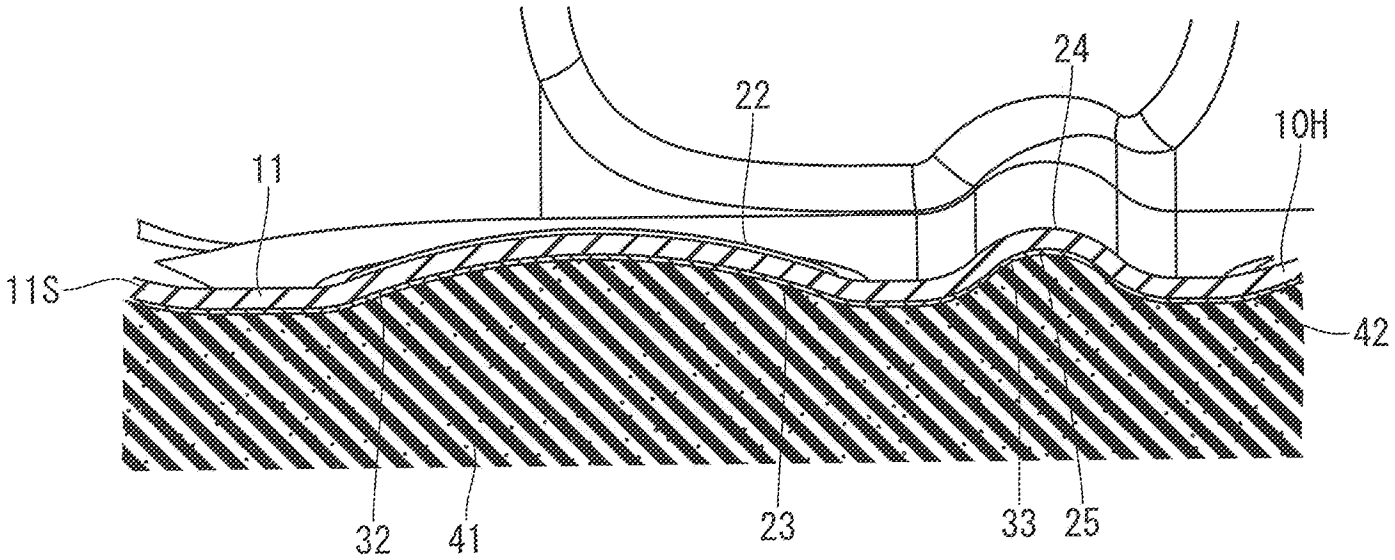
FIG. 7 is an enlarged view of a periphery of a bowl-shaped recess and a groove portion in FIG. 6.

As shown in FIGS. 5 and 6, the urethane foam material 41 is adhered to the outer surface of the oil pan body 10H without any gaps therebetween. Specifically, as shown in FIG. 7, the outer surface of the oil pan body 10H is cation treated to be a surface-treated layer 42, and the urethane foam material 41 is adhered to the outer surface of the oil pan body 10H by the surface-treated layer 42 without any gaps therebetween.

As shown in FIGS. 5 and 6, the urethane foam material 41 is arranged to cover the first undulating portion 31, the second undulating portion 32, and the third undulating portion 33. Specifically, the urethane foam material 41 is adhered to the bottom surface of the bowl-shaped recess 23 constituting the second undulating portion 32 without any gaps therebetween, and is also adhered to the bottom surface of the groove portion 25 constituting the third undulating portion 33 without any gaps therebetween. Furthermore, the urethane foam material 41 is adhered to part of the downward protrusion 21 constituting the first undulating portion 31 without any gaps therebetween.

The description on the configuration of the oil pan 10 is as made above. Next, a method for manufacturing the oil pan 10 will be described.

Figure 8:
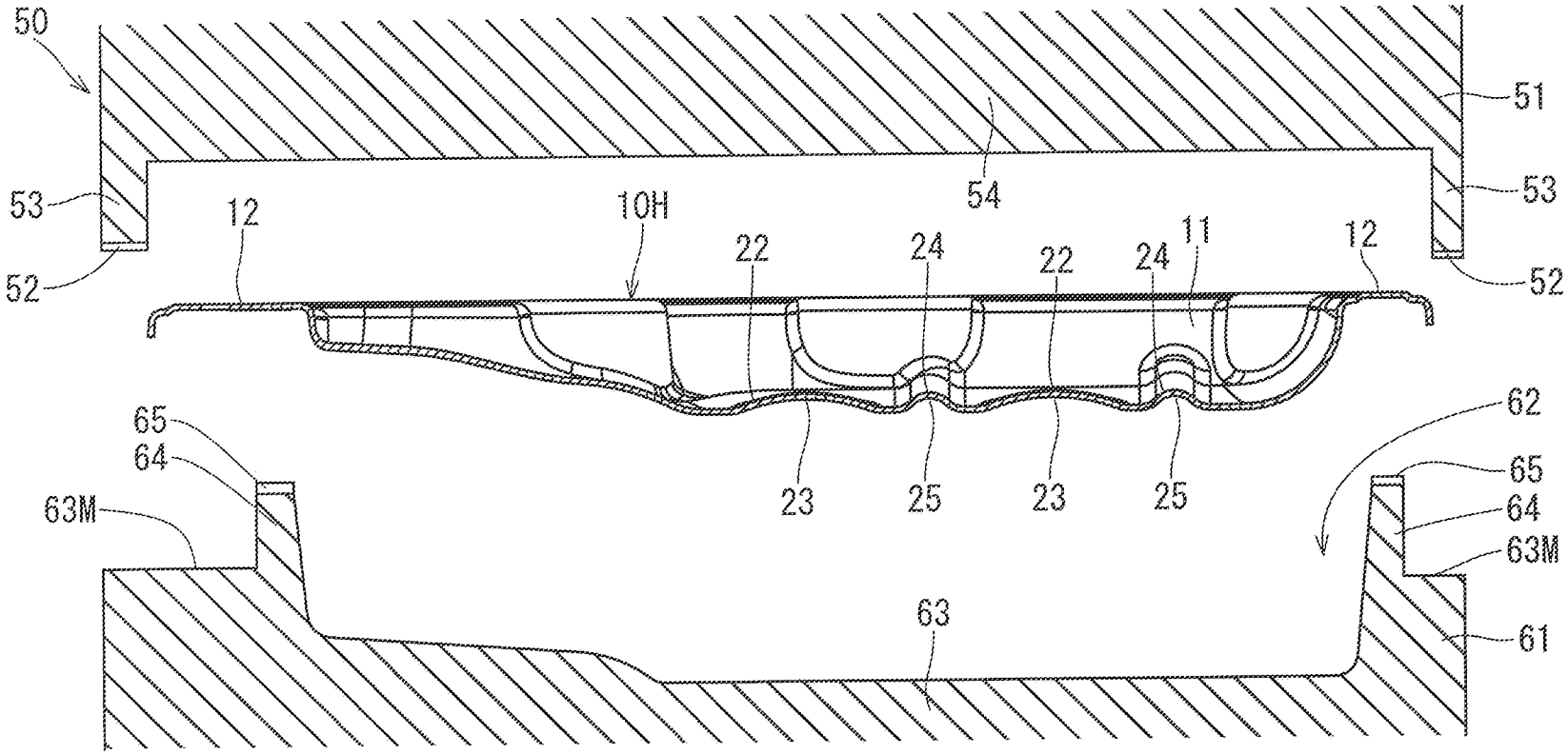
FIG. 8 is a cross-sectional view of a foaming mold before the oil pan body is set.

FIG. 8 shows a foaming mold 50 used for the manufacturing of the oil pan 10. The foaming mold 50 includes an upper mold 51 and a lower mold 61, both of which can be opened in the up and down direction. The upper mold 51 has a structure in which a side wall 53 hangs from an outer edge portion of a base wall 54. A lower end face of the side wall 53 is provided with a plurality of degassing grooves 52 so that the inner side communicates with the outer side of the side wall 53.

The lower mold. 61 includes a surrounding wall 64 projecting out toward the upper side from a portion closer to the outer edge of a base wall 63, where a portion arranged on the outer side than the surrounding wall 64 of the base wall 63 is a side part opposing surface 63M facing the side wall 53 of the upper mold 51. The inner side of the surrounding wall 64 is a molding portion 62 for foaming the urethane resin. A distal end face of the surrounding wall 64 is provided with a plurality of degassing grooves 65 so that the inner side communicates with the outer side of the surrounding wall 64.

In order to manufacture the oil pan 10, a sheet metal is first press molded to manufacture the oil pan body 10H. Here, the downward protrusion 21, the dome-shaped protrusion 22, and the bank portion 24 are formed in the container section 11 of the oil pan body 10H, so that the first to third undulating portions 31 to 33 are formed on the outer surface of the oil pan body 10H.

When the oil pan body 10H is obtained, the outer surface of the oil pan body 10H is cation treated and then serves as a surface-treated layer 42 on the outer surface of the oil pan body 10H (see FIG. 7). The cation treatment is performed on the entire outer surface of the oil pan body 10H.

Figure 9:
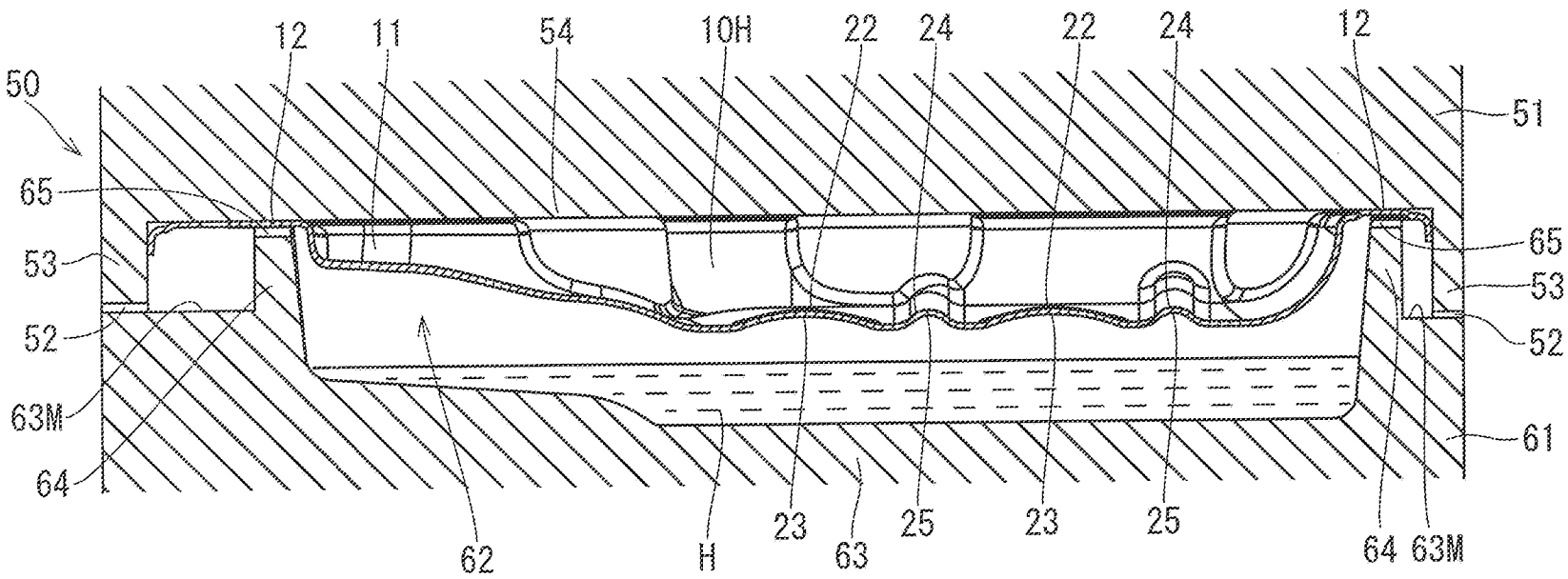
FIG. 9 is a cross-sectional view of the foaming mold in a state the oil pan body is set.
Figure 10:
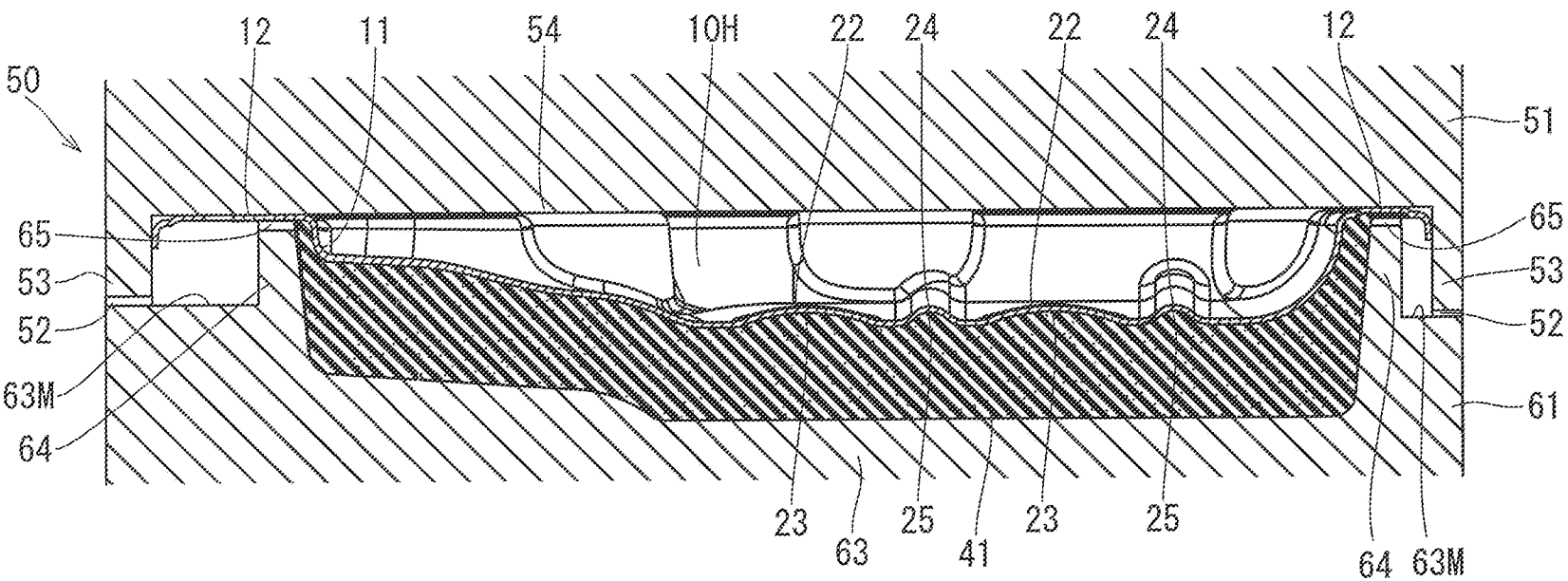
FIG. 10 is a cross-sectional view of the foaming mold after the foaming.

After the cation treatment is finished, the oil pan body 10H is set in the foaming mold 50, and a foaming undiluted solution H of urethane resin is injected into the molding portion 62 of the lower mold 61 (see FIG. 9). In this case, the flange section 12 of the oil pan body 10H is clamped by the base wall 54 of the upper mold 51 and the surrounding wall 64 of the lower mold 61. Furthermore, the lower end face of the side wall 53 of the upper mold 51 and the side part opposing surface 63M of the base wall 63 of the lower mold 61 are in an adjacent or joined state. The base wall 63 of the lower mold 61 is applied to the exposed region R1 (see FIGS. 3 to 5) including the discharging hole 18 of the outer surface of the oil pan body 10H, whereby the foam undiluted solution H is prevented from entering between the exposed region R1 on the outer surface of the oil pan body 10H and the base wall 63 of the lower mold 61.

Next, the foaming mold 50 is heated and held for a predetermined time at a predetermined temperature. The foam undiluted solution H is thereby foamed, thus forming the urethane foam material 41, and such urethane foam material 41 is adhered to the outer surface of the oil pan body 10H without any gaps therebetween (see FIG. 10).

The oil pan body 10H and the urethane foam material 41 are then removed from the foaming mold 50, thus obtaining the oil pan 10.

The description on the oil pan 10 and the method for manufacturing the same according to the present embodiment is as made above. Now, the effects of the oil pan 10 and the method for manufacturing the same will be described.

In the oil pan 10 according to the present embodiment, the vibration and the noise caused by the oil pan 10 are reduced by the urethane foam material 41 covering the outer surface of the oil pan body 10H. In the present embodiment, the outer surface of the oil pan body 10H is cation treated to be a surface-treated layer 42, and the urethane foam material 41 is adhered to the outer surface of the oil pan body 10H by the surface-treated layer 42 without any gaps therebetween, and thus the gap is less likely to be produced between the urethane foam material 41 and the outer surface of the oil pan body 10H, compared to a configuration in which a noise absorbing sheet is attached to the outer surface of the oil pan body 10H as in the conventional oil pan. Thus, the vibration and noise reduction effect can be improved, than before. In the method for manufacturing the oil pan 10 of the present embodiment, the oil pan body 10H after the cation treatment is inserted into the foaming mold 50, and the urethane resin is foamed in the foaming mold 50, and thus the urethane foam material 41 can be easily adhered to the outer surface of the oil pan body 10H without any gaps therebetween. The cation treatment has also an anticorrosion effect of the oil pan body 10H.

In the oil pan 10 of the present embodiment, the first to third undulating portions 31 to 33 are formed on the outer surface of the oil pan body 10H and hence in the configuration in which the sound absorbing sheet is attached to the outer surface of the oil pan body 10H as in the conventional oil pan, a gap is produced between the first to third undulating portions 31 to 33 and the sound absorbing sheet thereby making it difficult to improve the vibration and noise reduction effect. In the oil pan 10 of the present embodiment, however, the urethane foam material 41 is adhered to the first to third undulating portions 31 to 33 without any gaps therebetween, and thus the vibration and noise reduction effect can be improved. Furthermore, with the bowl-shaped recess 23 serving as the second undulating portion 32 and the groove portion 25 serving as the third undulating portion 33 formed in the oil pan body 10H, the rigidity of the oil pan body 10H can be enhanced, and the vibration and the noise caused by the oil pan body 10H can be reduced. Furthermore, since the first undulating portion 31 is formed with the downward protrusion 21 projecting downward and constituting the deepest portion 11D of the oil pan body 10H, the vibration and the noise caused by the oil pan body 10H can be reduced while the oil pan body 10H is made thinner.

OTHER EMBODIMENTS

The oil pan can be made with the following configuration, other than the above embodiments.

(1) In the oil pan 10 of the embodiment described above, the first to third undulating portions 31 to 33 are formed on the outer surface of the oil pan body 10H and the urethane foam material 41 is configured to be adhered to the first to third undulating portions 31 to 33 without any gaps therebetween, but one of the undulating portion of the first to third undulating portions 31 to 33 may be arranged and the urethane foam material may be adhered to such one undulating portion without any gaps therebetween.

(2) In the embodiment described above, the "undulating portion" is configured with the downward protrusion 21 constituting the deepest portion 11D of the oil pan body 10H (container section 11), but may be configured with, for example, a recess or the like formed in the container section 11 in order to avoid interference with the oil pan cover.

(3) In the method for manufacturing the oil pan 10 according to the embodiment described above, the cation treatment may be performed on both outer surface and inner surface of the oil pan body 10H.

(4) In the embodiment described above, the oil pan body 10H has a configuration to include the first to third undulating portions 31 to 33, but may have a configuration not to include any of the undulating portions.

REFERENCE SIGNS LIST

10 OIL PAN
10H OIL PAN BODY
11D DEEPEST PORTION
21 DOWNWARD PROTRUSION
23 BOWL-SHAPED RECESS
25 GROOVE PORTION
31 FIRST UNDULATING PORTION
32 SECOND UNDULATING PORTION
33 THIRD UNDULATING PORTION
41 URETHANE FOAM MATERIAL
42 SURFACE-TREATED LAYER
50 FOAMING MOLD

The invention claimed is:

1. An oil pan, comprising:

an oil pan body that has a bottom wall having a plurality of different depths by including a deepest portion disposed at a deepest position and a higher bottom portion disposed at a higher position than the deepest portion, and that has an outer surface being covered with a urethane foam material, wherein the outer surface of the oil pan body is cation treated for adhering the urethane material without any gaps therebetween and for preventing corrosion of the oil pan body to be a surface-treated layer, the oil pan body and the urethane foam material are integrally insert-molded, the urethane foam material is adhered to the outer surface of the oil pan body by the surface-treated layer without any gaps therebetween, and an outer surface of the higher bottom portion is made thicker by adhering the urethane foam material such that a height of the outer surface of the higher bottom portion becomes closer to a height of an outer surface of the deepest portion, thereby making the outer surface of the oil pan body flat; and an undulating portion formed on the outer surface of the oil pan body and undulating in an inward and outward direction, wherein the surface-treated layer is formed on the undulating portion, and the urethane foam material is adhered to the undulating portion without any gaps therebetween, the undulating portion includes a bowl-shaped recess recessed into a bowl shape toward an inner side of the oil pan body, and the urethane foam material is adhered to an entire inner surface of the bowl-shaped recess without any gaps therebetween.

2. The oil pan according to claim 1, wherein the undulating portion includes a groove portion recessed toward the inner side of the oil pan body, and the urethane foam material is adhered to an entire inner surface of the groove portion without any gaps therebetween.

3. The oil pan according to claim 2, further comprising a downward protrusion that is arranged on the oil pan body, projects out downward, and constitutes a deepest portion of the oil pan body, wherein at least part of the undulating portion is formed by the downward protrusion, and the urethane foam material is adhered to an outer surface of the downward protrusion without any gaps therebetween.

4. The oil pan according to claim 1, further comprising a downward protrusion that is arranged on the oil pan body, projects out downward, and constituting a deepest portion of the oil pan body, wherein at least part of the undulating portion is formed by the downward protrusion, and the urethane foam material is adhered to an outer surface of the downward protrusion without any gaps therebetween.

5. A method for manufacturing an oil pan having an oil pan body that has a bottom wall having a plurality of different depths by including a deepest portion disposed at a deepest position and a higher bottom portion disposed at a higher position than the deepest portion, and that has an outer surface being covered with a urethane foam material, the method comprising:

press molding a sheet metal to form the oil pan body;

performing a cation treatment to the outer surface of the oil pan body for adhering the urethane foam material without any gaps therebetween and for preventing corrosion of the oil pan body;

inserting the oil pan body after the cation treatment into a foaming mold;

foaming a urethane resin in the foaming mold to adhere the urethane foam material to the outer surface of the oil pan body; and making an outer surface of the higher bottom portion thicker by adhering the urethane foam material such that a height of the outer surface of the higher bottom portion becomes closer to a height of an outer surface of the deepest portion, thereby making the outer surface of the oil pan body flat, wherein when forming the oil pan body, an undulating portion undulating in an inward and outward direction in the outer surface of the oil pan body is formed, and the urethane foam material is adhered to an outer surface of the undulating portion, and when forming the undulating portion, a bowl-shaped recess recessed into a bowl shape toward an inner side of the oil pan body is formed.

6. The method for manufacturing the oil pan according to claim 5, wherein when forming the undulating portion, a groove portion recessed toward the inner side of the oil pan body is formed.

7. The method for manufacturing the oil pan according to claim 5, wherein when forming the oil pan body, a downward protrusion projecting downward and constituting a deepest portion of the oil pan body is arranged, and the undulating portion is formed with the downward protrusion.

8. The method for manufacturing the oil pan according to claim 6, wherein when forming the oil pan body, a downward protrusion projecting downward and constituting a deepest portion of the oil pan body is arranged, and the undulating portion is formed with the downward protrusion.

* * * * *